US006938556B1

(12) United States Patent
Reyes

(10) Patent No.: US 6,938,556 B1
(45) Date of Patent: Sep. 6, 2005

(54) CHRISTMAS LIGHT STORAGE TABLE

(76) Inventor: Emilio Reyes, 212 N. Casper, Casper, WY (US) 82601

( * ) Notice: Subject to any disclaimer, the term of this patent is extended or adjusted under 35 U.S.C. 154(b) by 150 days.

(21) Appl. No.: 10/265,306

(22) Filed: Oct. 3, 2002

Related U.S. Application Data

(60) Provisional application No. 60/326,954, filed on Oct. 3, 2001.

(51) Int. Cl.[7] ..... A47B 85/00

(52) U.S. Cl. ..... 108/25

(58) Field of Search ..... 108/25, 26, 144.11, 108/147, 50.01, 50.11, 161, 94, 95; 312/197, 312/204, 249.3, 292, 305

(56) References Cited

U.S. PATENT DOCUMENTS

| | | | | |
|---|---|---|---|---|
| 609,592 | A * | 8/1898 | Shultz | 108/25 |
| 3,103,899 | A * | 9/1963 | Macken | 108/25 |
| 3,951,079 | A * | 4/1976 | Tolleson | 108/94 |
| 4,643,107 | A * | 2/1987 | Gunn et al. | 109/48 |
| 5,403,079 | A * | 4/1995 | Fetisoff | 312/204 |
| 5,601,037 | A * | 2/1997 | Meyer et al. | 108/147 |
| 5,718,178 | A * | 2/1998 | Smith | 108/25 |

* cited by examiner

*Primary Examiner*—Jose V. Chen

(57) ABSTRACT

A storage table is disclosed for storing items such as strings of Christmas lights or other cords. The table acts as both a standard end table and a storage unit that stores items inside a base portion of the table. The table includes a top, at least one side adjacent to the top, and a bottom adjacent to the side that define a storage portion. Inside the storage portion, the table has a shaft for storing a string of lights around the shaft.

19 Claims, 6 Drawing Sheets

CHRISTMAS LIGHT STORAGE TABLE

CROSS-REFERENCE TO RELATED APPLICATION(S)

This application claims priority from co-pending provisional application No. 60/326,954, filed Oct. 3, 2001.

FIELD OF INVENTION

The present invention relates generally to furniture storage units. More particularly, it relates to a storage unit for storing a string of lights or a similar corded item in a base of an end table. Still more particularly, it relates to a system for storing Christmas lights by wrapping the lights around a shaft disposed within a base portion of an end table.

BACKGROUND

Christmas lights are decorative lights that generally include a primary cord that plugs into an outlet. Attached to the primary cord are lights that may have various colors. Some types of lights are replaceable, while others are permanently connected. Some Christmas lights are designed to look like icicles and include a plurality of shorter strings of lights connected to the primary cord, while other types of lights are connected directly to the primary cord.

For most people, Christmas lights are used seasonally. They are generally displayed inside or outside the house in December and removed later in the winter. When lights are removed from the house or other structure, they are then stored until the following year.

Storage of Christmas lights presents various problems. Perhaps the most common problem is breaking lights or damaging the cord. When lights are simply placed in a box, they may break when the box is dropped or when the lights touch each other. Also, the primary cord or other cord or connection may be bent in such a manner that the cord is damaged, possibly rendering the lights nonfunctional when they are removed the following year. Another problem with storing lights in a box is that separate strings of lights may become entangled. The strings may become knotted with themselves or with other strings. This creates a frustrating situation for the user when the lights are taken from storage the following year. These problems are in addition to the problem of finding sufficient space to store the boxes of lights.

One storage solution used by some individuals is to try to re-pack the lights into their original containers. Although this might provide limited protection and organization, the light strings are often difficult to fit back into their original container. Also, the string may still be bent, the string may still become twisted or knotted about itself, and the lights may still contact each other, causing the problems identified. Further, storage of lights in their original boxes does not solve the problem of requiring storage space in the home for storing the lights when they are not in use. What is needed is a more convenient way to store Christmas lights and other corded items.

SUMMARY

A storage table is disclosed for storing items such as strings of Christmas lights or other cords. The table acts as both a standard end table and a storage unit that stores items inside a base portion of the table. The table includes a top, at least one side adjacent to the top, and a bottom adjacent to the side that define a storage portion. Inside the storage portion, the table has a shaft for storing light strings wrapped around the shaft.

In another embodiment, a Christmas light storage apparatus is disclosed having a base with an inner shaft attached to the base at a bottom end of the inner shaft. An outer shaft is positioned coaxial with the inner shaft, and the outer shaft is adapted to rotate about the inner shaft to gather a cord around the outer shaft. The outer shaft has attached to it a means, such as a hook or other fastener for holding the cord while the outer shaft rotates, such that the cord wraps around the outer shaft.

In another embodiment, a storage table is disclosed having a bottom, four sides fixedly connected to each other, and a top. The top, bottom, and sides define a cavity for storing items, such Christmas lights and other corded items. The sides removeably connect to the top and to the bottom so that the sides and top can be removed to access the cavity. A shaft is disposed within the cavity and is used to store stings of lights or other corded items by wrapping the lights around the shaft. The shaft includes an inner shaft and an outer shaft. The inner shaft is fixedly connected to the bottom. The outer shaft is coaxial with the inner shaft and rotates relative to the inner shaft about a central longitudinal axis. A hook is connected to the outer shaft, which hook is used to engage a cord, such as an extension cord or a string of lights. A hand crank is connected to the outer shaft and is used to rotate the outer shaft relative to the inner shaft.

DETAILED DESCRIPTION

Figure 1:
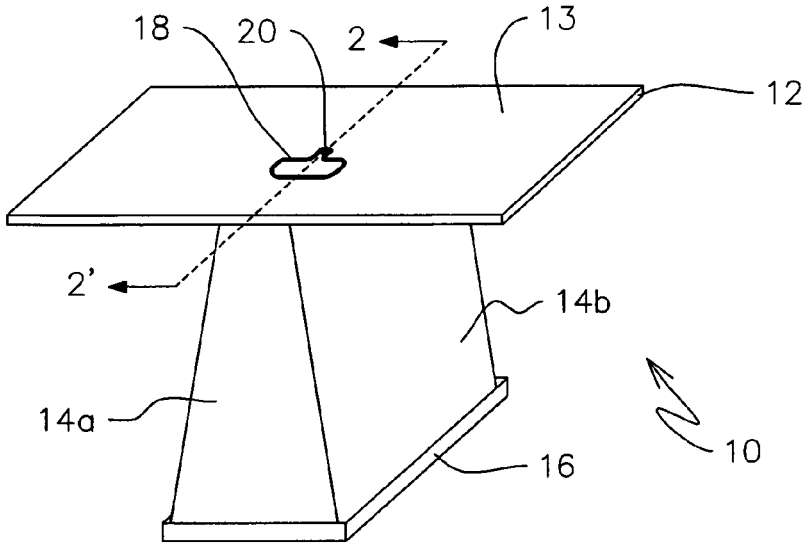
FIG. 1 shows a perspective view of a storage table.

FIG. 1 shows a perspective view of a storage table 10. The table 10 includes a top 12, a bottom 16, and sides 14*a*, 14*b*. Collectively, the sides 14*a*, 14*b* and bottom 16 may be referred to as the "base" of the table 10. In one embodiment, the table 10 includes four sides (e.g., 14*a*, 14*b*) and the bottom portion 16 is substantially rectangular. Lower edges of the sides 14*a*, 14*b* form corners with edges of the bottom portion 16. In the embodiment shown, the sides 14*a*, 14*b* extend generally vertically and slope toward a center of the table 10 near the top 12. The sides 14*a*, 14*b* define a cavity (not shown) inside the table 10. The table 10 may be constructed of various materials, such as wood, plastic, or metal. The top 12 of the table 10 is substantially flat in the embodiment shown in FIG. 1 and includes a top surface 13 and a bottom surface (not shown). The table 10 is adapted to allow placement of objects on the top surface 13, as with other conventional tables.

The table 10 also includes a handle 18 that is connected to the table 10 at a connector 20. In the embodiment shown in FIG. 1, the handle 18 pivotally connects to the table 10 at the connector 20 so that the handle 18 is in a vertical orientation perpendicular to the top surface 13 of the top 12 when in use and the handle 18 folds to a generally horizontal orientation parallel to the top surface 13 of the top 12. In the embodiment shown, the top surface 13 includes a recessed portion (not shown) that receives the handle 18 when the handle 18 is folded down when not in use. In one embodiment, the table 10 includes multiple, interchangeable tops (e.g. 12), which may have different sizes and shapes.

Figure 2:
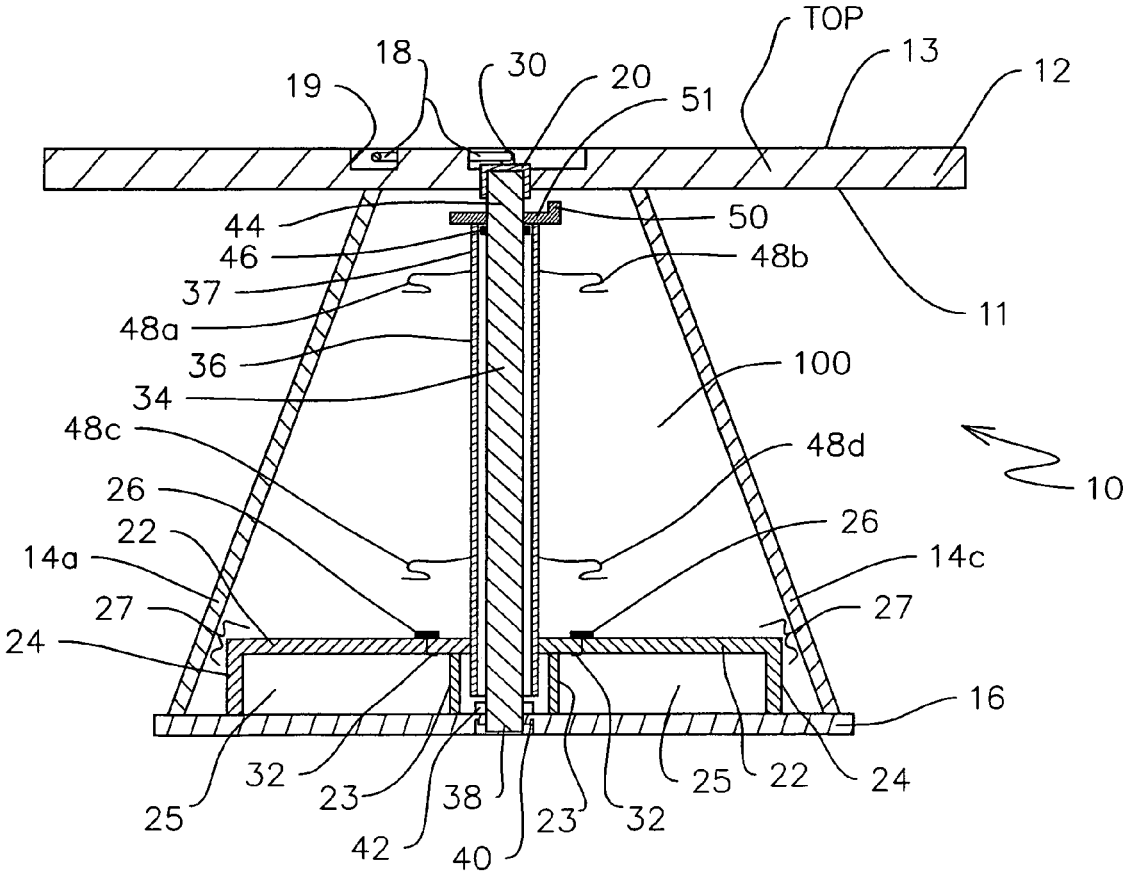
FIG. 2 shows a cross-section of the table shown in FIG. 1, taken along the line 2—2'.

FIG. 2 shows a cross-section of the table 10 shown in FIG. 1, taken along the line 2-2'. The table 10 includes a top 12, a bottom 16, and a plurality of sides 14*a*, 14*c*. In the embodiment shown in FIG. 2, the sides 14*a*, 14*c* generally abut edges of the bottom 16 and extend vertically up to the lower surface 11 of the table top 12. The sides 14*a*, 14*c* define a cavity 100 within the table 10. The cavity 100, also referred to as a storage portion 100, is used to store Christmas lights or similar corded objects (not shown).

In the embodiment shown in FIG. 2, the table 10 includes storage compartments 27 that define accessory cavities 25 for storing objects, such as light bulbs, fuses, or other accessories used with Christmas lights. The storage compartments 27 comprise sides 23, 24, a rear portion 32, a lid 22 connected to the rear portion 32 by a hinge 26 or similar connector. The accessory cavity 25 is further defined by the bottom 16 of the table 10.

A shaft assembly extends vertically within the cavity 100 of the table 10 and is used for gathering Christmas lights or similar items. The shaft assembly (also referred to generally as a "shaft") includes an inner shaft 34 and an outer shaft 36 that are generally coaxial. The inner shaft 34 and the outer shaft 36 are spaced apart from each other to allow relative rotational movement between the inner shaft 34 and the outer shaft 36 about a central longitudinal axis. In the embodiment shown in FIG. 2, the inner shaft 34 includes an upper end 44 and a lower end 38. The inner shaft 34 is fixedly connected to the bottom 16 of the table 10 by a lock nut 40 and a washer 42. The upper end 44 of the shaft 34 includes threads adapted to engage the connector 20 of the handle 30. The connector 20 includes flanges 30 that abut the top 12 of the table 10 within a recessed portion 19 defined within the top surface 13 of the top 12. The connector 20 engages the threads of the upper end 44 of the inner shaft 34, thereby urging the top 12 of the table 10 down toward the sides 14*a*, 14*c* such that the top 12 is firmly connected to the base of the table 10 when the table 10 is in use and items are placed on the top surface 13. The handle 18 pivotally connects to the connector 20, such that the handle 18 is in a vertical orientation when the handle 18 is used to lift the table 10 and is in a generally horizontal orientation when the handle 18 is folded down into the recessed portion 19. In one embodiment, the inner shaft 34 is is a solid or hollow rod formed from steel or other metal.

In one embodiment the outer shaft 36 is a hollow, elongated tube, such as a plastic or a polyvinyl chloride ("PVC") tube. The outer tube 36 includes one or more hooks 48*a–d* for engaging a cord such as a Christmas light string. In the embodiment shown in FIG. 2, the hooks 48*a–d* include four metal portions, such as bent wires that are curved to receive electrical plugs of a cord, such as a Christmas light string. A hand crank 50 is connected near a top end 37 of the outer shaft 36 and is used to gather a string of Christmas lights or a cord. In use, the hand crank 50 is used to rotate the outer shaft 36 relative to the inner shaft 34 along a central longitudinal axis, such that a Christmas light string, with a plug of the string engaged by one of the hooks 48*d*, is wound around the outer shaft 36. In the embodiment shown in FIG. 2, a washer 46 is connected to the inner shaft 34 immediately below the flat plate 51 of the hand crank 50, and is used to suspend the outer shaft 36 above the bottom 16 of the table 10, so the outer shaft 36 may more freely rotate about the inner shaft 34.

Figure 3:
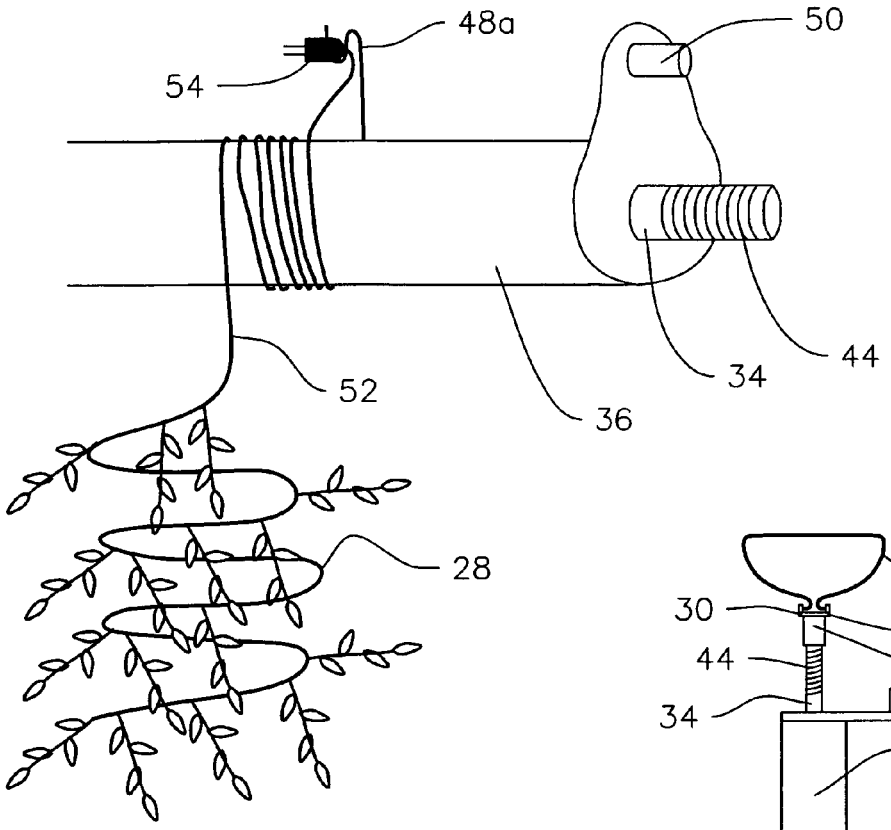
FIG. 3 shows a shaft of the table, around which a string of lights may be wrapped.

FIG. 3 shows a shaft of the table 10 around which a string of lights 28 may be wrapped. The shaft includes an inner shaft 34 having a top end 44 with threads. The shaft also includes an outer shaft 36 disposed coaxial with the inner shaft 34. A hand crank 50 is connected to an end of the outer shaft 36 and is used to rotate the outer shaft 36 about the inner shaft 34, for example in the direction indicated by the arrow in FIG. 3. To wrap a cord or a string of lights 28, the cord or string 28 is engaged by one of the hooks 48*a* connected to the outer shaft 36, for example at a plug 54 of the central cord 52. In the embodiment shown in FIG. 3, a bundle of lights 28 includes a central cord 52 that wraps around the outer shaft 36 as the hand crank 50 rotates the outer shaft 36 about the inner shaft 34.

Figure 4:
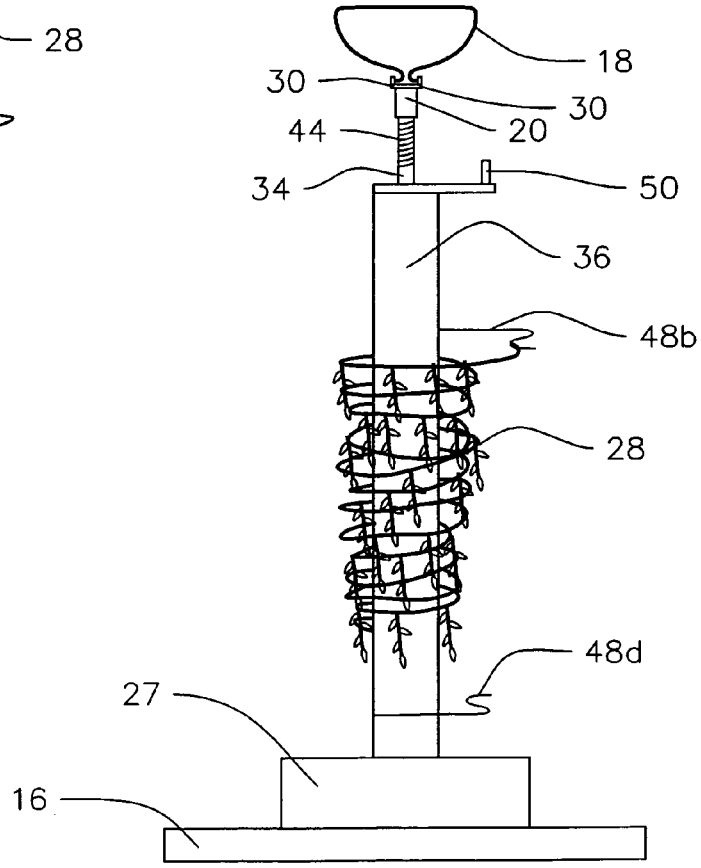
FIG. 4 shows the table of FIG. 1 with the top and sides removed, thereby exposing the shaft of FIG. 3 attached to a bottom portion of the table.

FIG. 4 shows the table 10 of FIG. 1 with the top (12 in FIG. 1) and sides (14*a*–14*d* in FIG. 1) removed, thereby exposing the shaft of FIG. 3 attached to the bottom portion 16 of the table 10. An accessory compartment 27 is shown in FIG. 4 connected to the bottom 16 of the table 10. The compartment 27 includes sides (23, 24 in FIG. 2), a lid (22 in FIG. 2), a rear portion (32 in FIG. 2), and a hinge (26 in FIG. 2) that connects the rear portion (32 in FIG. 2) to the lid (22 in FIG. 2), though these items are not specifically identified in FIG. 4. In FIG. 4, a string of lights 28 has been wound around the outer shaft 36 after the string 28 has been engaged by the hook 48*b*. The hand crank 50 is used to rotate the outer shaft 36 about the inner shaft 34. In the embodiment shown in FIG. 4, the handle 18 and connector 20 may be reconnected to the top end 44 of the inner shaft 34 after the top (12 in FIG. 1) has been removed from the base. This allows the handle 18 to be used to carry the wound string of lights 28 without the sides (14*a*, 14*c* in FIG. 1) and top (12 in FIG. 1). This provides a convenient way of toting the wound lights 28 for example outside of a person's house while the lights 28 are being installed. Also shown in FIG. 4 is a second hook 48*d* that is not in use. To unwind the lights, the user may simply pull on the string 28 in a direction generally perpendicular to the longitudinal axis, causing the outer shaft 36 to rotate relative to the inner shaft 34, thereby unwinding the string 28.

Figure 5:
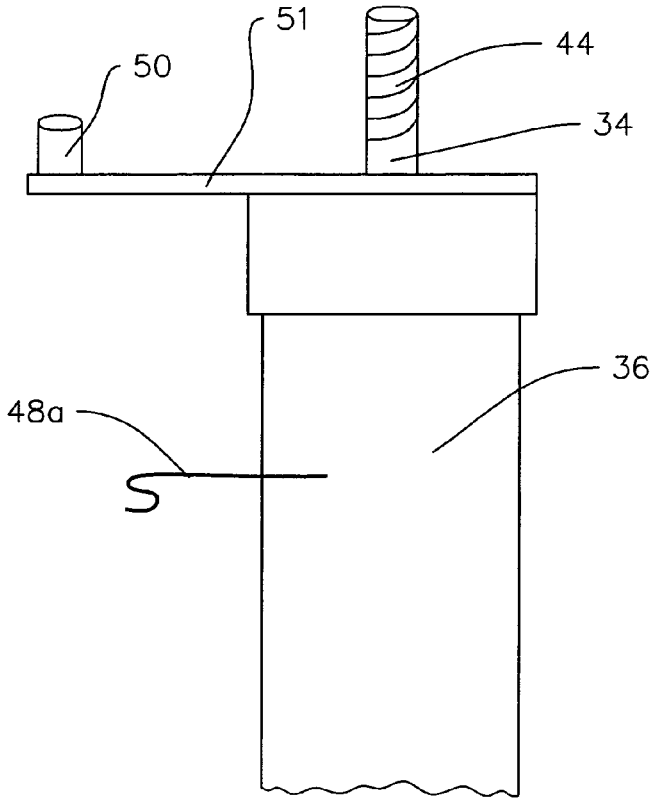
FIG. 5 shows a side view of the shaft assembly with a hand crank.

FIG. 5 shows a side view of the shaft with a hand crank 50. The hand crank 50 is attached to an upper portion of the shaft 36 and includes a plate 51, which generally runs perpendicular to the central longitudinal axis of the inner and outer shafts 34, 36. The hand crank 50 is used to rotate the outer shaft 36 about the inner shaft 34. The plate 51 of the hand crank 50 defines an opening (not shown) through which the inner shaft 34 extends. The opening has a diameter slightly larger than an outer diameter of the inner shaft 34, such that the outer shaft 36 is permitted to rotate about the inner shaft 34, but the opening in the plate 51 of the hand crank 50 keeps the outer and inner shafts 36, 34 substantially aligned, in the embodiment shown in FIG. 5.

Figure 6:
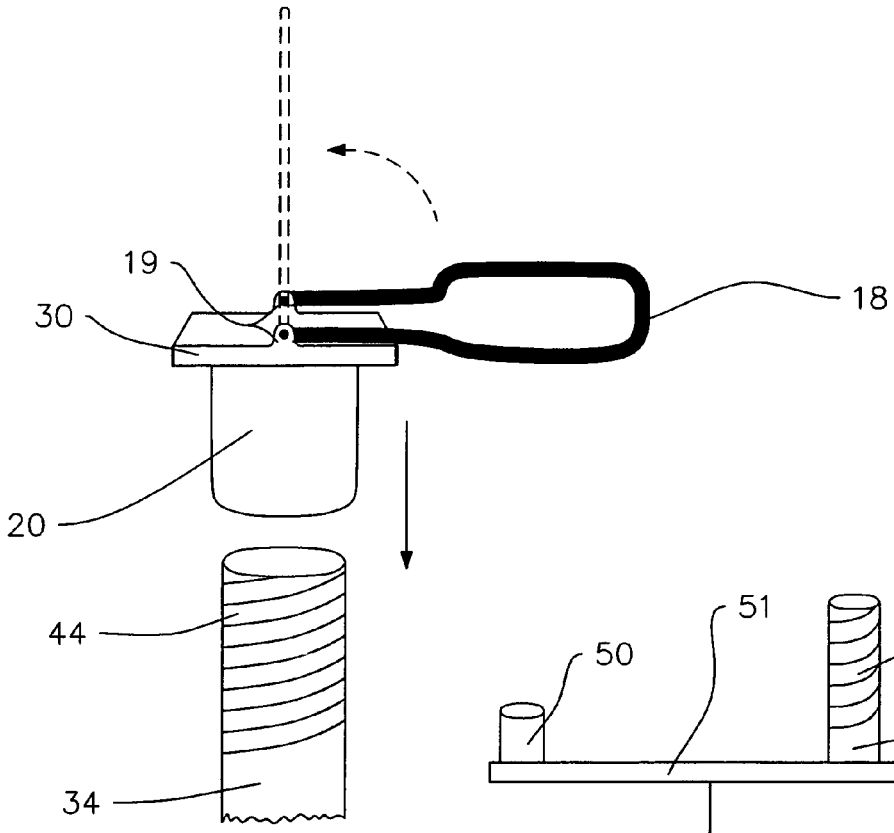
FIG. 6 shows a handle that attaches to a top end of an inner shaft of the table.

FIG. 6 shows a handle 18 that attaches to a top end 44 of an inner shaft 34 of the table 10. In the embodiment shown in FIG. 6, the top end 44 of the inner shaft 34 includes threads that mate with similar threads (not shown) inside the connector 20. The connector 20 is positioned on top of the threads of the top end 44 and the connector 20 is rotated about the threads to engage the inner shaft 34 with the connector 20. When the connector 20 is attached to the inner shaft 34 and the top 12 of the table 10 is in place, the flange 30 of the connector 20 helps hold down the top 12 of the table 10 to the base. In the embodiment shown in FIG. 6, the handle 18 is pivotally connected to the connector 20 at pivot points 19. This allows the handle 18 to fold down when the handle 18 is not in use, and to extend upwardly when the handle 18 is used to carry the table 10, with or without the top 12 and sides 14*a–d* attached.

Figure 7:
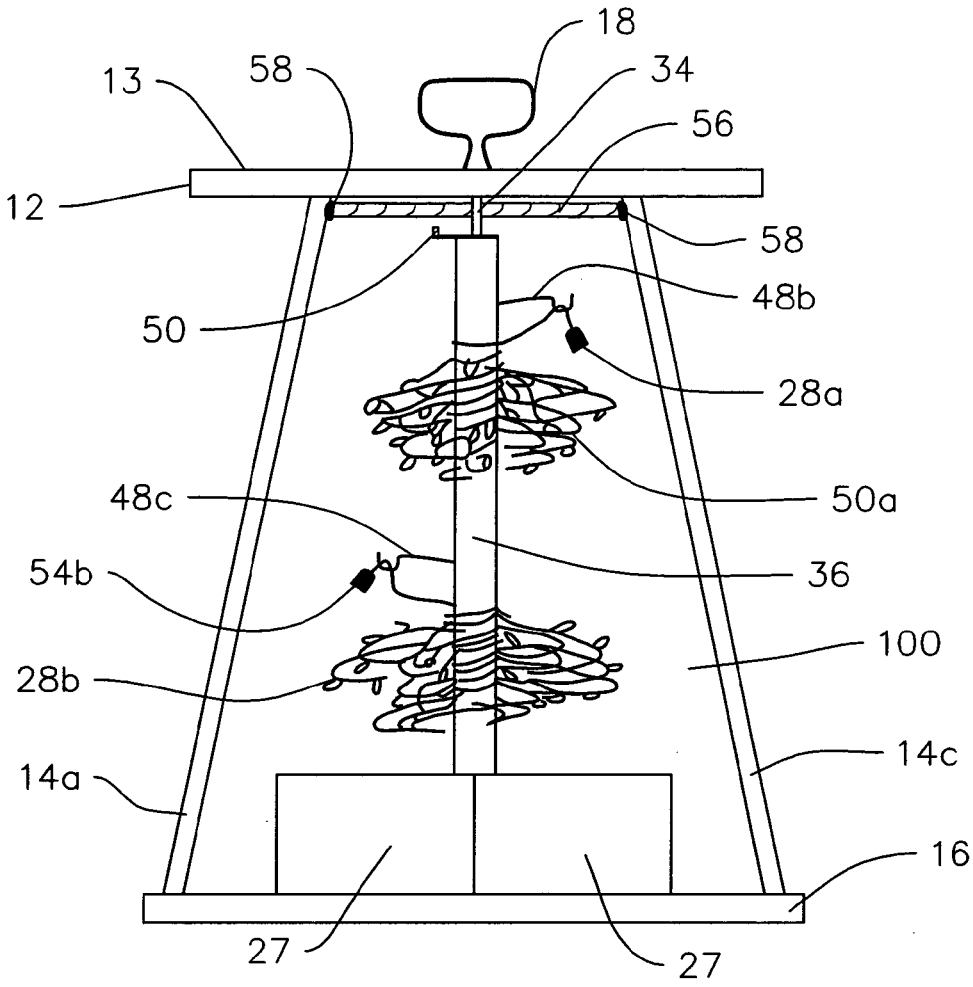
FIG. 7 shows a side view of the table with one side removed to illustrate the strings of light bulbs wrapped around the shaft.

FIG. 7 shows a side view of the table 10 with one side (e.g. 14*b* in FIG. 1) removed to illustrate the strings of light bulbs 28*a–b* wrapped around the outer shaft 36. The strings 28*a–b* are contained within the cavity 100 defined by the sides 14*a*, 14*c* of the table 10. In one embodiment the table 10 has four sides (e.g. 14*a–d*) and substantially encloses the lights within the cavity 100, such that the lights cannot be seen from outside the table 10 when the table 10 is assembled. From the outside, the table 10 appears like an ordinary end table because it hides the items it stores. In the embodiment shown in FIG. 7, the flange (30 in FIG. 6) of the connector (20 in FIG. 6) is used to hold the top 12 of the table 10 down towards the base of the table 10. The sides 14*a*, 14*c* are each connected to each other in this embodiment, but are not connected permanently to the bottom 16 or the top 12. The flanges (30 in FIG. 6) effectively sandwich the sides 14*a*, 14*c* between the top 12 and the bottom 16 to hold the table 10 together. A rope 56 or similar item is used to remove the sides 14*a*, 14*c* from the table 10, after the top 12 has been removed in one embodiment. To remove the top 12 and dissemble the table 10 in order to access the lights 50*a*, 50*b*, the handle 18 is twisted causing the connector to twist (20 in FIG. 6) thereby disengaging the connector (20 in FIG. 6) from the inner shaft 34. After the connector (20 in FIG. 6) is removed, the top 12 may be removed from the table 10. A user may then lift the rope 56 upwardly to remove the sides (14*a–d*) of the table 10 together as a unit. The rope 56 is connected to two of the sides 14*a*, 14*c* at connecting points 58 in the example of FIG. 7.

Figure 8:
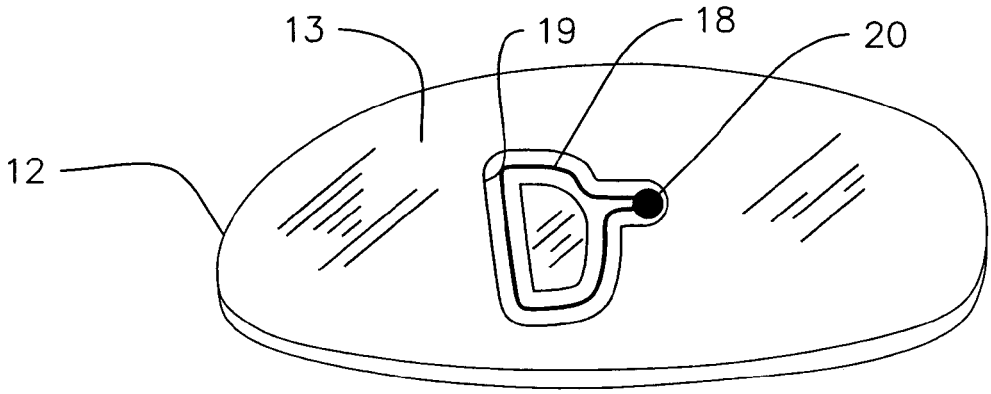
FIG. 8 shows a top of a table having an indentation that receives a handle.

FIG. 8 shows a top 12 of a table 10 having a recessed portion 19 that receives the handle 18. The recessed portion 19 also receives the connector 20, and the flanges (30 in FIG. 2) of the connector 20 abut the top 12 of the table 10 within the recessed portion 19.

Figure 9:
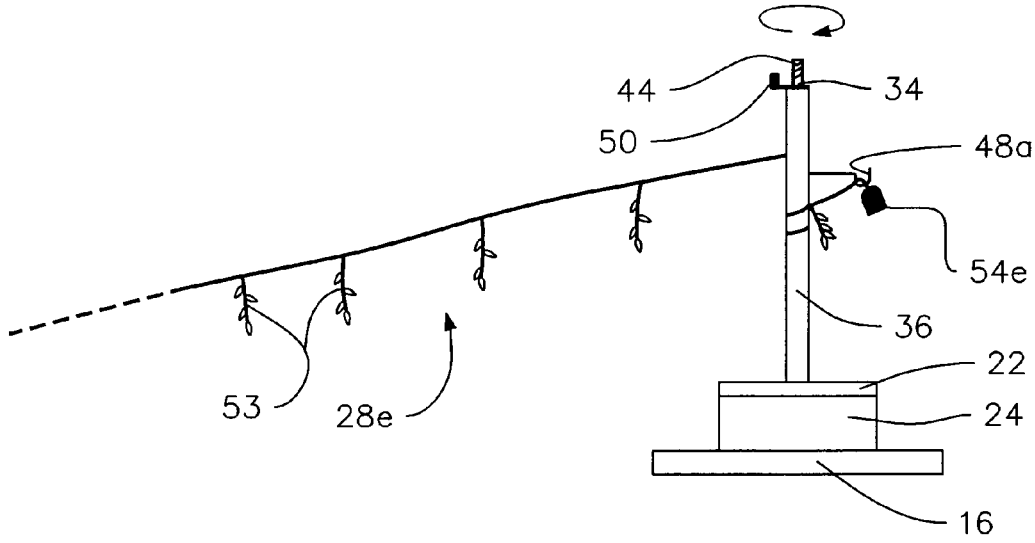
FIG. 9 shows the shaft of the table in use collecting a string of lights.

FIG. 9 shows the shaft assembly of the table 10 in use collecting a string of lights 28*e*. In the embodiment shown in FIG. 9, the string lights 28*e* are icicle-style lights having central cord 52*e* and a plurality of strings of lights 53 attached to the central cord 52*e*. The central cord 52*e* of the lights 28*e* is wound around the outer shaft 36 as the hand crank 50 rotates the outer shaft 36 about the inner shaft 34, for example in the direction indicated by the arrow in FIG. 9. A hook 48*a* connected to the outer shaft 36 engages a plug 54*e*, or similar portion of the lights 28*e*, to hold the lights 28*e* in place as the central cord 52*e* of the string 28*e* is wrapped around the outer shaft 36. Multiple strings (e.g. 28*e*) may be connected to each other, for example, using the electrical plugs (e.g. 54*e*), and may be wrapped around the shaft using a single hook 48*a*. A compartment (27 in FIG. 2) is shown having a lid 22 and a side 24, which can be used for storing light bulbs and similar accessories.

Figure 10:
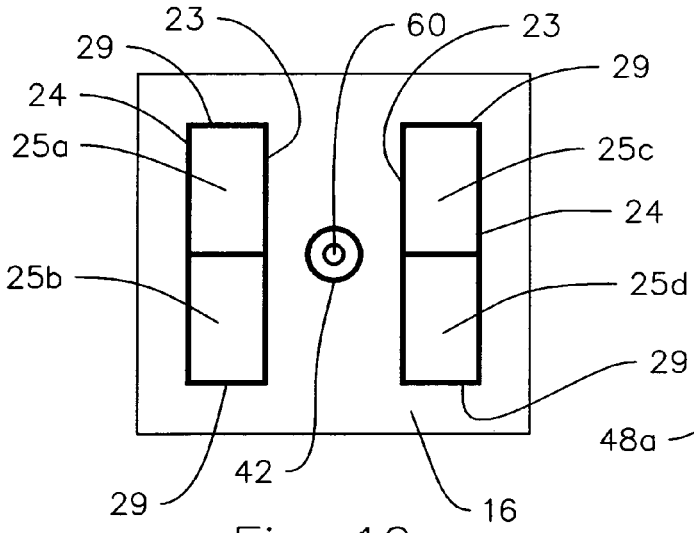
FIG. 10 shows a top view of the bottom portion of the table, including the storage compartments.

FIG. 10 shows a top view of the bottom 16 portion of the table 10, including the storage compartments (27 in FIG. 2). In the embodiment shown in FIG. 10, the storage compartments (27 in FIG. 2) include side walls 23, 24, 29 that define cavities 25*a–d*, which can be used to store items. In the embodiment shown in FIG. 10, the inner shaft (34 in FIG. 2) connects to the bottom 16 through a hole 60 in the bottom 16 where the inner shaft (34 in FIG. 2) engages a lock nut (40 in FIG. 2) or similar connector. A washer 42 is also connected to the bottom 16 where the inner shaft (34 in FIG. 2) connects to the bottom 16. In one embodiment, the inner shaft (34 in FIG. 2) is fixedly connected to the bottom 16, such that only the outer shaft (36 in FIG. 20) and not the inner shaft (34 in FIG. 2) rotates about the central longitudinal axis as a string of lights (28 in FIG. 4) is wound around the outer shaft (36 in FIG. 2).

Figure 11:
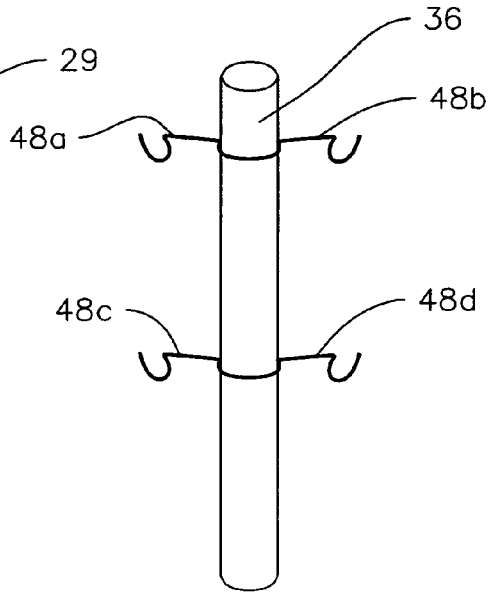
FIG. 11 shows an embodiment of the outer shaft with hooks to engage a string of lights.

FIG. 11 shows an embodiment of the outer shaft 36 with hooks 48*a–d* to engage a string of lights (e.g. 28 in FIG. 4). In the embodiment shown in FIG. 11, two sets of hooks (e.g., 48*a*, 48*b*) are formed from a single piece of metal, such as wire that wraps around the outer shaft 36 and extends outwardly from the outer shaft 36 to form bends in the wire that engage the cord or string of lights.

Figure 12:
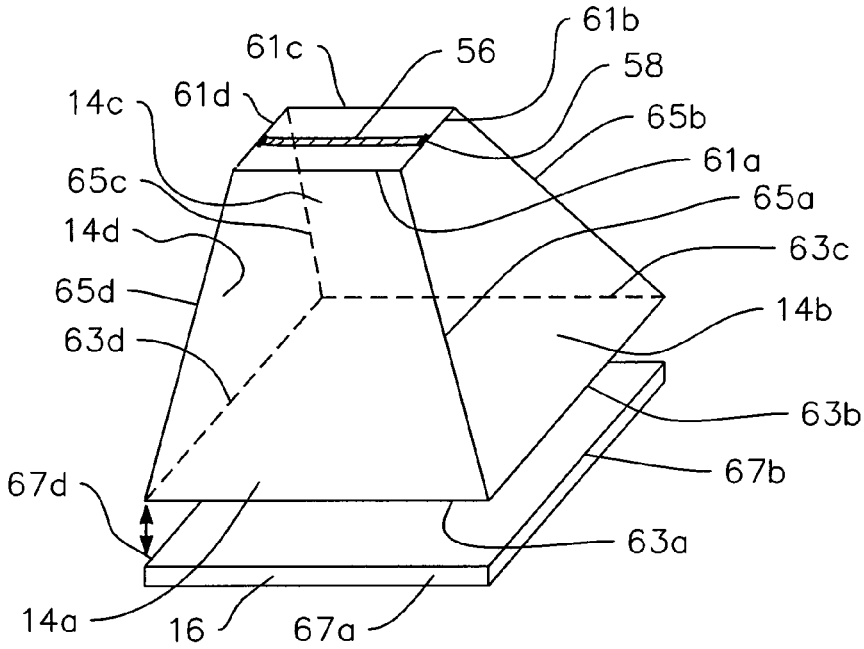
FIG. 12 sides of one embodiment of the table.

FIG. 12 shows sides 14*a–d* of one embodiment of the table 10. In the embodiment shown in FIG. 12, the sides 14*a–d* have been removed from the rest of the table 10, for example to access the cavity 100. The sides 14*a–d* have top and bottom ends 61*a–d*, 63*a–d*. In the embodiment shown in FIG. 12, the sides 14*a–d* are connected to each other at corners 65*a–d* and may be removed together using a rope 56 connected to upper ends 61*b*, 61*d* of the sides 14*a–d* in this embodiment.

In one embodiment, the lower edges 63*a–d* of the sides 14*a–d* abut edges 67*a–d* of the bottom 16. In one embodiment, the bottom 16 is approximately twelve inches wide by twelve inches long. In one embodiment, the table is approximately 24 inches high. In one embodiment, the upper end edges 61*a–d* of the sides 14*a–d*, where the sides 14*a–d* meet the lower surface (11 in FIG. 2) of the top 12 form a square that is approximately six inches by six inches.

Figure 13:
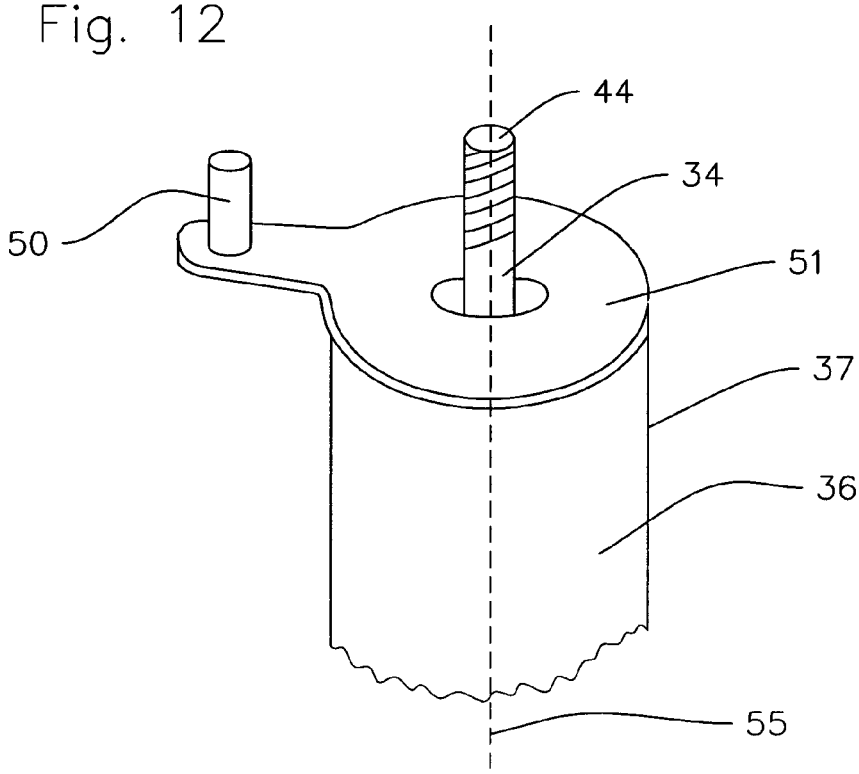
FIG. 13 shows a more detailed view of the relation between the inner and outer shafts.

FIG. 13 shows a more detailed view of the relation between the inner and outer shafts 34, 36. The hand crank 50 includes a plate 51 attached to an upper portion 37 of the outer shaft 36. The plate 51 is substantially flat in the embodiment shown and defines a hole 53 through which the upper end 44 of the inner shaft 34 extends. The outer shaft 36 rotates relative to the inner shaft 34 along a central longitudinal axis 55, shown by the dashed line in FIG. 13. The hole 57 has a diameter that is slightly larger than the outside diameter of the inner shaft 34 and smaller than the inside diameter of the outer shaft 36. This size of the hole 57 allows the outer shaft 36 to rotate freely about the inner shaft 34, but helps to keep the outer shaft 36 substantially aligned with the inner shaft 34, along the central longitudinal axis 55.

Although the present invention has been described with respect to particular embodiments thereof, variations are possible. The present invention may be embodied in specific forms without departing from the essential spirit or attributes thereof. It is desired that the embodiments described herein be considered in all respects illustrative and not restrictive and that reference be made to the appended claims and their equivalents for determining the scope of the invention.

What is claimed is:

1. A table comprising:

a top;

one or more sides adjacent to the top, wherein the one or more sides define a storage portion;

a bottom adjacent to the one or more sidewalls; and a shaft disposed within the storage portion that connects the top and bottom to the one or more sidewalls, wherein the shaft is adapted to hold an elongated cord wrapped around the shaft, wherein the shaft comprises:

an inner shaft having a bottom end fixedly connected to the bottom and a top end releaseably connected to the top; and an outer shaft coaxial with the inner shaft, wherein the outer shaft rotates about a central longitudinal axis relative to the inner shaft, and wherein the outer shaft is adapted to hold the elongated cord, whereby the cord is contained within the storage portion.

2. The table of claim 1, further comprising an accessory compartment, connected to the bottom.

3. The table of claim 2, wherein the accessory compartment is contained within the storage portion.

4. The table of claim 1, further comprising a handle that pivotally connects to the top end of the inner shaft.

5. The table of claim 4, wherein the top comprises a top surface having a recessed portion that receives the handle.

6. The table of claim 1, further comprising means for rotating the outer shaft relative to the inner shaft.

7. The table of claim 1, further comprising a hand crank connected to an upper end of the outer shaft, which hand crank is adapted to rotate the outer shaft relative to the inner shaft about the central longitudinal axis.

8. The table of claim 7, wherein the hand crank includes a plate that covers a top end of the outer shaft, wherein the plate defines a hole through which the inner shaft protrudes, wherein the hole in the top plate has a diameter that is larger than an outside diameter of the inner shaft and smaller than an inside diameter of the outer shaft, and wherein the hole aids in aligning the outer and inner shafts along the central longitudinal axis.

9. A Christmas light storage apparatus comprising:

a base;

an inner shaft having top and bottom ends, the bottom end being fixedly attached to the base;

an outer shaft coaxial with the inner shaft, wherein the outer shaft is adapted to rotate relative to the inner shaft to gather a cord around the outer shaft;

means for securing the cord to the outer shaft to hold the cord while the outer shaft rotates about the inner shaft.

10. The apparatus of claim 9, wherein the cord is a string of Christmas lights.

11. The apparatus of claim 9, wherein the base is adapted for holding the inner and outer shafts in a substantially vertical orientation.

12. The apparatus of claim 9, further comprising an accessory storage compartment connected to the base.

13. The apparatus of claim 9, wherein the top end of the inner shaft extends beyond a top end of the outer shaft, and further comprising a handle connected to the top end of the inner shaft.

14. The apparatus of claim 9, further comprising a crank that rotates the outer shaft relative to the inner shaft.

15. A storage table comprising:

a bottom;

a plurality of sides, each of the sides being fixedly connected to adjacent sides;

a top, wherein the sides removeably connect to the bottom and to the top, wherein the bottom, sides, and top define a substantially enclosed cavity; and a shaft disposed within the cavity, the shaft comprising an inner shaft having upper and lower ends, the lower end being fixedly connected to the bottom;

an outer shaft disposed coaxial with the inner shaft, wherein the outer shaft rotates relative to the inner shaft about a central longitudinal axis;

a hook connected to the outer shaft, the hook being adapted to engage a cord;

a hand crank connected to the outer shaft, wherein the hand crank rotates the outer shaft about the inner shaft;

a connector connected to the upper end of the inner shaft, wherein the connector removeably connects the top to the sides.

16. The table of claim 15, further comprising a handle pivotally connected to the connector, and wherein the top includes a top surface having a recessed portion that receives the handle when the handle is pivoted to a generally horizontal position.

17. The table of claim 15, wherein the hook extends generally perpendicular from the central longitudinal axis and includes a bent portion adapted to engage an electric plug.

18. The table of claim 15, wherein the shaft includes four hooks connected to the outer shaft, each of the hooks formed from a metal wire, and wherein the hooks include two pairs of hooks connected proximate each other, the first pair being connected near an upper portion of the lower shaft and the second pair being connected lower on the shaft relative to the first pair.

19. The table of claim 15, further comprising an accessory compartment disposed within the cavity.

* * * * *